US006047653A

United States Patent [19]

Cash

[11] Patent Number: 6,047,653

[45] Date of Patent: Apr. 11, 2000

[54] SEWING MACHINE WITH A TAKE-UP LEVER MOVING UP AND DOWN THROUGH ONE CYCLE PER REVOLUTION OF A ROTARY CYLINDRICAL HOOK BASE

[76] Inventor: David R. Cash, 9309 Holiday Dr., Louisville, Ky. 40272

[21] Appl. No.: 08/874,936

[22] Filed: Jun. 13, 1997

[51] Int. Cl.[7] ..... D05B 57/12; D05B 49/02

[52] U.S. Cl. ..... 112/199; 112/181; 112/241

[58] Field of Search ..... 112/36, 38, 54, 112/154, 182, 221, 181, 443, 448, 459, 241, 57, 245, 242, 243, 246, 244, 247, 197, 192, 199, 220, 287

[56] References Cited

U.S. PATENT DOCUMENTS

| | | | |
|---|---|---|---|
| 103,949 | 6/1870 | Wendell | 112/245 |
| 1,149,351 | 8/1915 | Erickscon | 112/57 |
| 1,419,996 | 6/1922 | Valois | 112/57 |
| 2,121,652 | 6/1938 | Cooper | 112/57 |
| 2,438,636 | 3/1948 | Ivandick | 112/241 |
| 2,543,475 | 2/1951 | Slodysko | 112/229 |
| 2,748,731 | 6/1956 | Bell | 112/241 |
| 4,537,142 | 8/1985 | Hirose | 112/231 |
| 4,665,850 | 5/1987 | Shimizu | 112/231 |
| 4,817,545 | 4/1989 | Mikuni et al. | 112/241 |
| 5,131,338 | 7/1992 | Vogel et al. | 112/241 |

*Primary Examiner*—John J. Calvert
*Assistant Examiner*—Tejash D Patel
*Attorney, Agent, or Firm*—Middleton & Reutlinger; Daniel C. Stellter, Esq.; James C. Eaves, Esq.

[57] ABSTRACT

A sewing machine for forming a "lock stitch" in a fabric material includes a reciprocally-mounted needle bar, a reciprocally-mounted needle thread take-up lever, and a rotary hook assembly located beneath the needle bar. In one embodiment, the sewing machine includes a needle thread take-up lever mounting and reciprocally moving device for reciprocally moving the take-up lever such that the distal needle thread engagement end thereof moves up and down in an arcuate path at a constant speed in timed relationship with the reciprocal movement of the needle bar. In another embodiment of the swing machine, wherein the rotary hook assembly comprises a rotary cylindrical hook and a cylindrical bobbin case holder concentrically disposed in the hook base, the sewing machine includes a drive for rotating the cylindrical hook in a first rotational direction in timed relationship with the reciprocation of the needle bar, and a device for oscillating the cylindrical bobbin case holder from an initial position in a counter-rotational direction to a second position and then back to the initial position in timed relationship to the rotational position of the hook base. In still another embodiment, the sewing machine also comprises a needle thread sweep arm at a preselected location about the circumference of the rotary hook base and mounted for rotation with the rotary hook base.

18 Claims, 9 Drawing Sheets

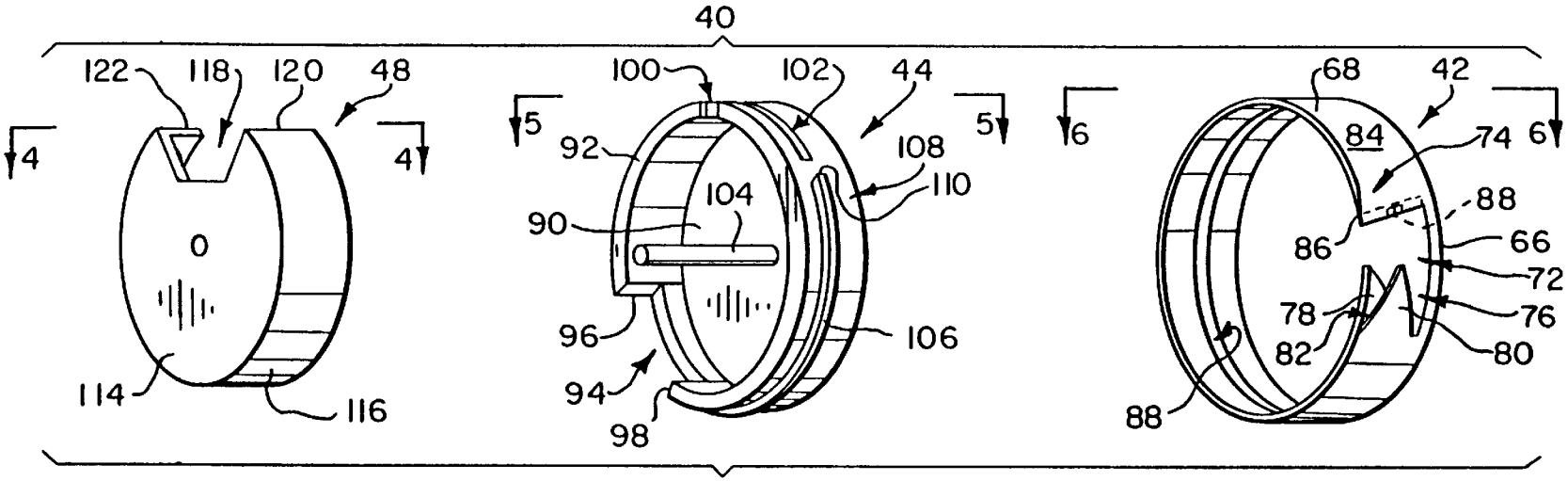
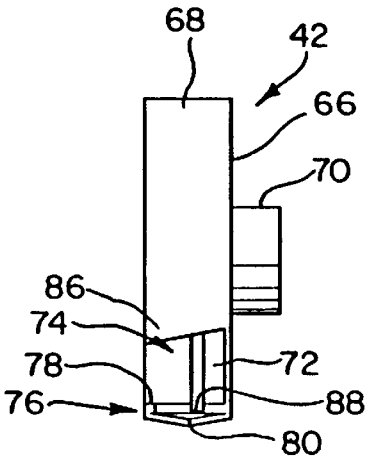
FIG. 6 (PRIOR ART)
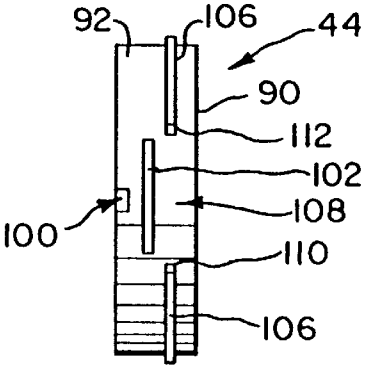
FIG. 5 (PRIOR ART)
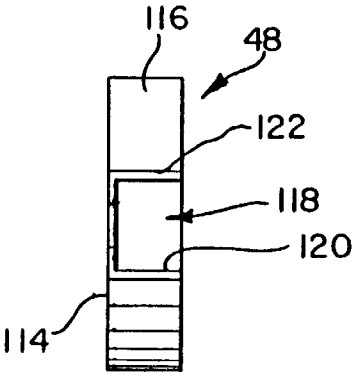
FIG. 4 (PRIOR ART)
FIG. 3 (PRIOR ART)

SEWING MACHINE WITH A TAKE-UP LEVER MOVING UP AND DOWN THROUGH ONE CYCLE PER REVOLUTION OF A ROTARY CYLINDRICAL HOOK BASE

BACKGROUND OF THE INVENTION

1. Technical Field of the Invention

The present invention relates to sewing machines. More particularly, the present invention relates to a sewing machine for forming a "lock stitch" in a fabric.

2. Discussion of the Prior Art

Sewing machines for forming "lock stitches" in a fabric are known. For example, the Union Special Corporation makes a "lock stitch" sewing machine which is exemplary of the heretofore known "lock stitch" sewing machines. These known "lock stitch" sewing machines includes a reciprocally-mounted needle bar, a needle thread take-up lever, and a rotary hook assembly mounted beneath the needle bar. The rotary hook assembly includes a rotary hook base and a cylindrical bobbin case holder concentrically disposed within the cylindrical hook base and a finger device for holding the bobbin case holder stationary. In the known sewing machine, in order to form a "lock stitch", the rotary hook base makes two revolutions per each cycle of the needle bar, and the needle thread engagement distal end of the needle thread take-up lever moves in an arcuate path upwardly twice as fast as it moves in the downstroke. Therefore, the heretofore known "lock stitch" must operate at high speeds.

A more complete detailed description of these heretofore known "lock stitch" sewing machines is given in the following detailed description.

SUMMARY OF THE INVENTION

The present invention recognizes the drawbacks of the heretofore known "lock stitch" sewing machines and provides a solution which greatly simplifies the process of forming a "lock stitch".

The present invention provides a sewing machine particularly well suited for forming a "lock stitch" which can be operated at such slower operating speeds than the heretofore known "lock stitch" sewing machines.

More particularly, in one embodiment, the present invention provides a sewing machine comprising a reciprocally-mounted needle bar, means for reciprocally moving the needle bar up and down, a reciprocally-mounted needle thread take-up lever having a proximal end and a distal end for engaging a strand of needle thread, means for reciprocally moving the take-up lever such that the distal needle thread engagement end moves up and down in an arcuate path at a constant speed in timed relationship with the reciprocal up and down movement of the needle bar, a rotary hook assembly located beneath the needle bar, the rotary hook assembly comprising a rotary cylindrical hook base and a cylindrical bobbin case holder concentrically disposed to the cylindrical hook base, and means for rotating the rotary cylindrical hook base in one rotational direction in timed relationship with the up and down reciprocal movement of the needle bar and with the up and down reciprocal movement of the take-up lever.

In another embodiment, the present invention provides a sewing machine comprising a reciprocally-mounted needle bar, means for reciprocally moving the needle bar up and down, a reciprocally-mounted needle thread take-up lever, means for reciprocally moving the take-up lever up and down in timed relationship with the reciprocal up and down movement of the needle bar, a rotary hook assembly located beneath the needle bar, the rotary hook assembly comprising a rotary cylindrical hook base, and a cylindrical bobbin case holder concentrically disposed to the cylindrical hook base, means for rotating the rotary cylindrical hook base in a first rotational direction in timed relationship with the up and down reciprocal movement of the needle bar and with the up and down reciprocal movement of the take-up lever, and means for oscillating the cylindrical bobbin case holder from an initial position in a counter-rotational direction to the first rotational direction of movement of the cylindrical hook base through a predetermined angle of rotation to a second position, and for rotating the cylindrical bobbin case holder back in to the initial position in the first rotational direction of the movement of the cylindrical hook base in timed relationship to the rotational position of the cylindrical hook base.

BRIEF DESCRIPTION OF THE DRAWINGS

A better understanding of the present invention will be had upon reference to the following description in conjunction with the accompanying drawings in which like numerals refer to like parts, and wherein:

FIG. 3 is an exploded, perspective view of a heretofore known cylindrical rotary hook assembly of the sewing machine of FIG. 1;

FIG. 4 is a side view of a component of the rotary hook assembly of FIG. 3;

FIG. 5 is a side view of another component of the rotary hook assembly of FIG. 3;

FIG. 6 is a side view of still another component of the rotary hook assembly of FIG. 3;

DETAILED DESCRIPTION OF THE PREFERRED EMBODIMENT

Figure 1:
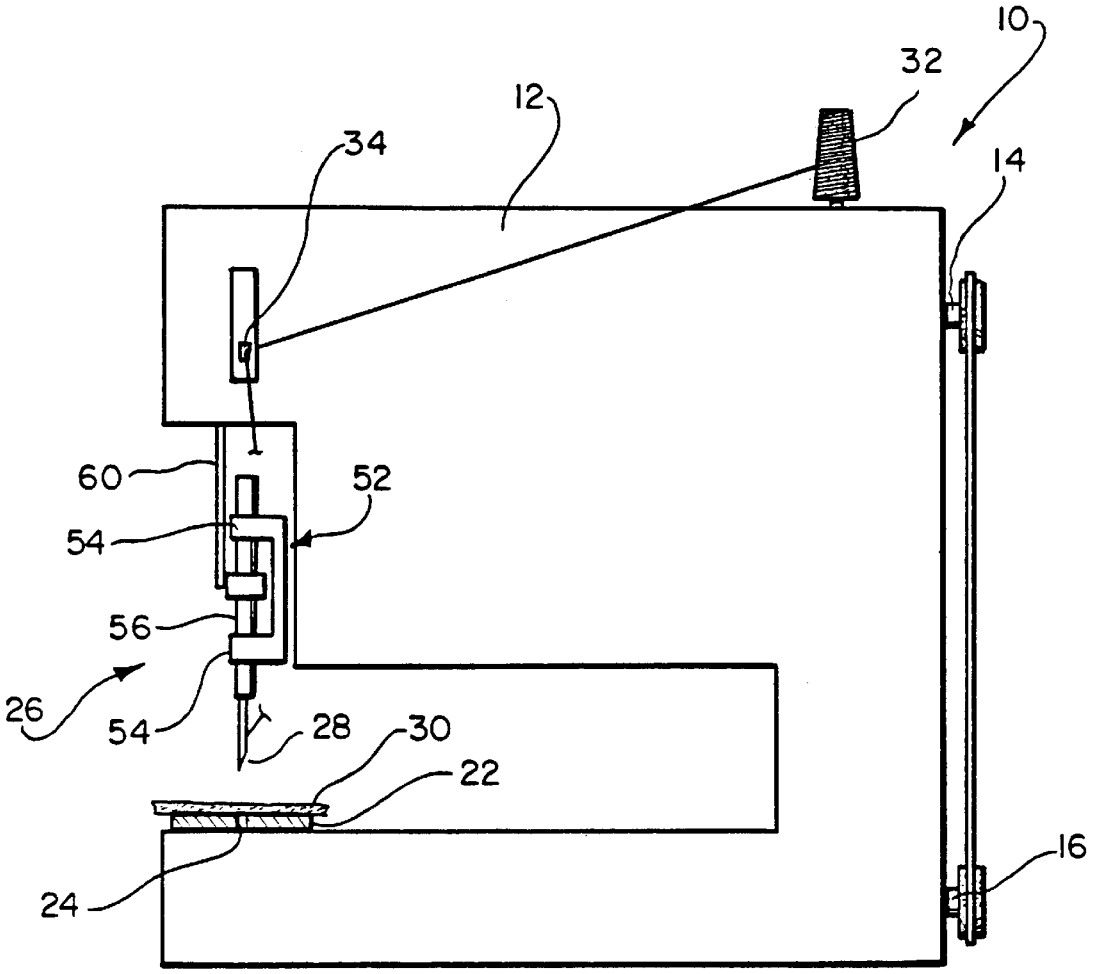
FIG. 1 (PRIOR ART)
FIG. 1 is a side view of a heretofore known sewing machine.
Figure 2:
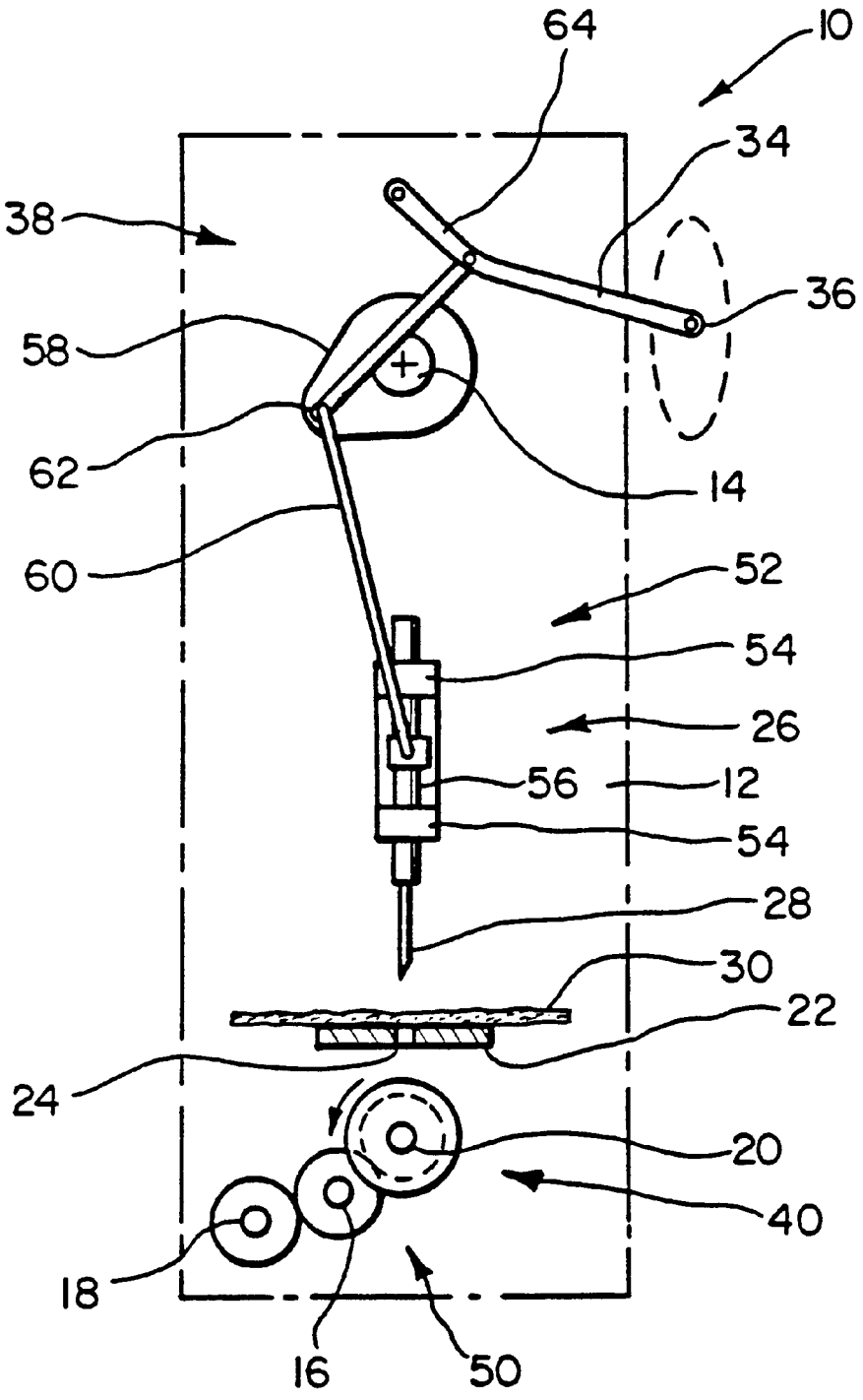
FIG. 2 (PRIOR ART)
FIG. 2 is a front view of the sewing machine of FIG. 1.
Figure 8:
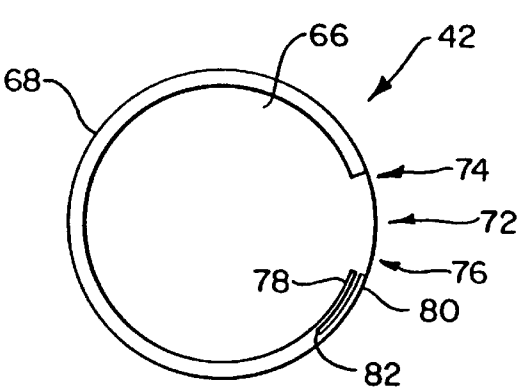
FIG. 8 (PRIOR ART)
FIG. 8 is a front view of the rotary hook assembly component of FIG. 5.

With reference to FIGS. 1 and 2, there is shown in schematic format, a known sewing machine, generally denoted as the numeral 10, for sewing a stitch line in a fabric. More particularly, the sewing machine 10 forms a known stitch that interlocks a needle thread with a bobbin thread, commonly referred to in the industry as a "lock stitch".

As shown, the conventional sewing machine 10 comprises a frame 12 with a top main drive shaft 14 extending through the top portion of the frame 12, a bottom main drive shaft 16 extending through the bottom portion of the frame 12 parallel to the top main drive shaft 14, a walking dog drive shaft 18 in the bottom portion of the frame 12 parallel to and driven from the bottom main drive shaft 16, and a rotary hook assembly drive shaft 20 in the bottom portion of the frame parallel to and driven from the bottom main drive shaft 16.

The sewing machine 10 includes a throat plate 22 secured to the frame 12, formed with a needle clearance aperture 24 therethrough. Needle holding and reciprocating means 26 is mounted to the frame 12 over the throat plate 22 for holding a needle 28 and reciprocating the needle 28 downwardly and through the throat plate needle clearance aperture 24 and upwardly and out of the throat plate needle clearance aperture 24. The fabric 30 (shown in phantom lines) is supported on the top surface of the throat plate 22. A supply source of needle thread 32 is located at a convenient location relative to the sewing machine 10 for supplying a strand of needle thread to the needle 28. A needle thread take-up lever (or needle thread slack arm) 34 is mounted to the frame 12 above the needle 28 and has a needle thread engaging hole at its distal end 36 for engaging the strand of needle thread leading to the needle 28. Needle thread take-up lever moving means 38 moves the distal end 36 of the needle thread take-up lever 34 in an elliptical path upwardly away from the needle 28 and throat plate 22 and downward toward the needle 28 and throat plate 22 in timed relationship with the reciprocation of the needle 28.

With reference to FIGS. 2–8, a cylindrical rotary hook assembly 40 is located beneath the throat plate 22 in alignment with the throat plate needle clearance aperture 24. The rotary hook assembly 40 is comprised of three components: a cylindrical hook base 42, a cylindrical basket or bobbin case holder 44 concentrically disposed in the hook base 42 for holding a bobbin of bobbin thread, and a bobbin case 48 concentrically mounted within the basket or bobbin case holder 44 for holding the bobbin in position in the basket or bobbin case holder 44. The rotary hook assembly 40, and more particularly the cylindrical base 42, is rotated in a first rotational direction (for example counter-clockwise when viewed from the front as shown) by rotary hook assembly rotating means 50 in timed relationship with the reciprocation of the needle 28 and elliptical motion of the distal end 36 of the needle thread take-up lever 34.

With reference to FIGS. 1 and 2, there is shown (in schematic format) a conventional known type needle holding and reciprocating means 26. As shown, the needle holding and reciprocating means 26 comprises a needle bar walker frame 52 pivotally attached to the frame 12 and includes needle bar receiving collars 54. A needle bar 56 is coaxially received through the needle bar receiving collars 54 for longitudinal reciprocal movement therein in the downward direction and in the upward direction. The needle 28 is mounted to the depending end of the needle bar 56 for movement with the needle bar 56. An eccentric 58 is mounted to the end of the top main drive shaft 14 of the sewing machine 10 projecting from the front of the frame 12 for rotation therewith. The needle bar 56 is interconnected to the eccentric 58 by a connecting rod 60, which is pivotally attached at one end to the eccentric 58 and pivotally attached at its other end to the needle bar 56. Rotation of the eccentric 58 is transferred to the needle bar 56 and translated into linear motion of the needle bar 56 by the connecting rod 60.

With continued reference to FIGS. 1 and 2, the needle thread take-up lever 34 is pivotally connected at a proximal end 62 to the eccentric 58 coaxial with the pivotal connection of the connecting rod 60 to the eccentric 58 and so that the distal lever end 36 projects beyond the side of the frame 12. The takeup lever moving means 38 also includes a connecting link 64 which is pivotally connected at one end to the frame 12 above the eccentric 58 and pivotally connected at its other end to the needle thread take-up lever 34 between the take-up lever distal end 36 and proximal end 62.

With reference to FIGS. 3 through 8, as previously mentioned, the rotary hook assembly 40 includes a rotary cylindrical hook base 42, cylindrical basket or bobbin case holder 44, and a bobbin case 48.

The cylindrical rotary hook base 42 comprises a back wall 66 and discontinuous perimeter side wall 68 projecting from the perimeter of and from the front face of the back wall 66. With additional reference to FIG. 7, a shaft mounting collar 70 projects rearwardly from the rear face of the back wall 66 and receives the projecting end of the rotary hook assembly drive shaft 20 of the sewing machine 10 for rotating the cylindrical rotary hook base 42 with the sewing machine rotary hook assembly drive shaft 20 in a first rotational direction (shown as counter-clockwise when viewed from the front as shown). The discontinuous perimeter arcuate wall 66 extends circumferentially over a sector of a circle and defines a bobbin thread and needle clearance segmental gap 72 defined between the first 74 and second 76 ends of the perimeter arcuate side wall 68. The sector of the perimeter arcuate side wall 68 is substantially larger than the gap 72. The perimeter arcuate side wall 68 and back wall 66 define a cylindrical bobbin case holder receiving pocket open to the front of the hook base 42. A circumferentially facing needle thread loop hook point 78 is formed at the second end 76 of the arcuate side wall 68 facing toward the first end 74 and spaced from the first end 74 of the arcuate side wall 68 across the segmental gap 72. A circumferentially facing needle thread deflector point 80 is formed at the outer peripheral surface of the peripheral wall 68 overlapping and spaced outwardly from the needle thread hook point 78 radially of the side wall 68 and facing in the same circumferential direction as the needle thread loop hook point 78. A needle thread stop flange 82 projects outwardly from the outer surface of the perimeter side wall 68 in the space between the needle thread loop hook point 78 and needle thread deflector point 80 to form a bottom wall of the space between the needle thread loop hook point 78 and overlapped needle thread deflector point 80, which bottom wall functions as a needle thread stop as will hereinafter be discussed. An arcuate thread retainer plate 84 having a thread retainer point 86 formed in the peripheral surface of the peripheral wall 68 to the opposite side of the segmented gap 72 (or at the first end 74 of the arcuate wall 68) from the needle thread hook point 78 with the thread retainer point 86 circumferentially facing toward and circumferentially spaced from the needle thread loop hook point 78. A circumferential groove or raceway 88 is formed in the inside surface of the perimeter arcuate side wall 68.

The cylindrical basket or bobbin case holder 44 comprises a back wall 90 and a discontinuous perimeter arcuate side wall 92 projecting from the perimeter of and from the front face of the back wall 90. The discontinuous perimeter side wall 92 extends circumferentially over a sector of a circle and defines a bobbin thread clearance segmental gap 94 between the first 96 and second 98 ends of the arcuate side wall 92. The first end 96 is located at approximately the 9:00 o'clock location and the second end 98 is located at approximately the 6:00 o'clock location relative to the cylindrical bobbin case holder 44 when viewed from the front of the cylindrical bobbin use holder 44. Therefore, the thread clearance gap 94 extends in a counter-clockwise direction over a segment or arc of approximately 90 Degrees from approximately the 9:00 o'clock location to approximately the 6:00 o'clock location of the cylindrical case holder 44. The peripheral wall 92 is formed with a bobbin case holder positioning finger-receiving notch 100 open to the free edge of the peripheral wall 92 at the 12:00 o'clock location of the peripheral wall 92. Therefore, the bobbin case positioning notch 100 is spaced about 90 Degrees circumferentially of the arcuate side wall 92 from the first end 96 of the arcuate side wall 92. A needle thread and needle clearance slot 102 is formed through the peripheral wall 92 behind the notch 100. The needle clearance slot 102 extends circumferentially of the side wall 92 and is longitudinally centered on the positioning notch 100. Further, a bobbin support axle 104 projects coaxially from the front surface of the back wall 90 toward the front of the bobbin-receiving basket 44, or in the same direction as the peripheral side wall 92 so that the axle 104 and peripheral side wall 92 are coaxial. The outside circumferential dimension of the case holder arcuate side wall 92 is less than the inside circumferential dimension of the arcuate side wall 68 of the rotary hook base 42. The perimeter arcuate side wall 92 and back wall 90 define a cylindrical bobbin case receiving pocket open to the front of the bobbin case holder 44. A discontinuous circumferentially extending rail 106 projects from the outer surface of the arcuate side wall 92 and is sized and configured to be received within the circumferentially extending raceway 88 of the side wall 68 of the cylindrical hook base 42. The discontinuous circumferential rail 106 extends over a segment of a circle and defines a segmental gap 108 between a first rail end 110 and a second rail end 112. The cooperation of the rail 106 in the raceway 88 holds the bobbin basket 44 in position in the hook base 42 as the hook base 42 rotates relative to the stationary bobbin basket 44. The first rail end 110 is located at approximately the 12:30 o'clock location and the second rail end 112 is located between the 9:00 o'clock and 12:00 o'clock location, such as, for example, the 11:30 location, relative to the cylindrical bobbin case holder 44 when viewed from the front of the cylindrical bobbin case holder 44. The second end 112 of the rail 106 defines a needle thread loop detainer point and the first end 110 of the rail 106 defines a needle thread loop release point. The first end or release point 110 of the rail 106 is positioned adjacent to and clockwise from the bobbin case positioning notch 100, and the second end or detainer point 112 of the rail 106 is positioned counter-clockwise from the bobbin case positioning notch 100. A cylindrical thread bobbin is received within the bobbin case holder 44 over the bobbin supporting axle 104 which allows the thread bobbin to rotate on the axle 104 relative to the stationary bobbin basket or bobbin case holder 44.

The cylindrical bobbin case 48 concentrically fits within the peripheral side wall 92 of the cylindrical bobbin-receiving basket or bobbin case holder 44 and closes the open front side of the bobbin-receiving basket or bobbin case holder 44 to enclose the bobbin located over the bobbin-supporting axle 104 in the cylindrical bobbin-receiving basket or bobbin case holder 44. The cylindrical bobbin case 48 includes a circular front wall 114 and a discontinuous perimeter side wall 116 projecting from the rear face of the front wall 114 in a rearward direction. The discontinuous side wall 116 extends circumferentially over a sector of a circle and defines a bobbin thread and needle clearance segmental gap or slot 118 between a first end 120 and a second end 122 of the arcuate side wall 116. The gap or slot 118 is located at the 12:00 o'clock location of the cylindrical bobbin case 48 so that the location of the gap or slot 118 coincides with the location of the needle clearance slot 102 of the side wall 92 of the bobbin case holder 44. The circumferential width of the gap or slot 118 measured between the first 120 and second 122 ends circumferentially of the side wall 116 is approximately equal to the width of the needle clearance slot 102 in the side wall 92 of the bobbin case holder 44. The outside circumferential dimension of the bobbin case side wall 116 is less than the inside circumferential dimension of the bobbin case holder side wall 92. The perimeter bobbin case side wall 116 and the bobbin case front wall 114 define a cylindrical bobbin-receiving pocket open to the rear of the bobbin case 48. With the cylindrical bobbin case 48 positioned within the cylindrical bobbin case holder 44, the bobbin case peripheral side wall 116 is concentrically located within the bobbin case holder peripheral side wall 92, the slot 118 is in alignment with the needle clearance slot 102 of the bobbin case holder side wall 92, and the bobbin case front wall 114 closes the front opening of the bobbin case holder 44 defined by the free circumferential edge of the bobbin case holder side wall 92 so that the bobbin case 48 encloses the thread bobbin located in the bobbin case holder 44. The bobbin case 48 is fastened in place to the bobbin case holder 44 by a spring clip (not shown) to prevent any rotation of the bobbin case 48 relative to the bobbin case holder 44. The bobbin thread strand extends from the bobbin upwardly through the slot 118 of the peripheral wall 116 of the bobbin case 48, through the needle clearance slot 102 of the peripheral wall 92 of the bobbin case holder 44, and upwardly through the needle clearance aperture 24 of the throat plate 22.

Figure 10:
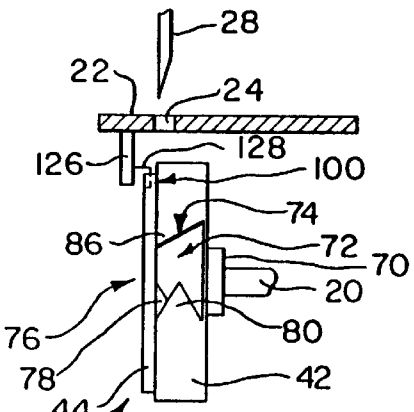
FIG. 10 (PRIOR ART)
FIG. 10 is a side view as seen in the direction of arrows 10—10 in FIG. 9.
Figure 7:
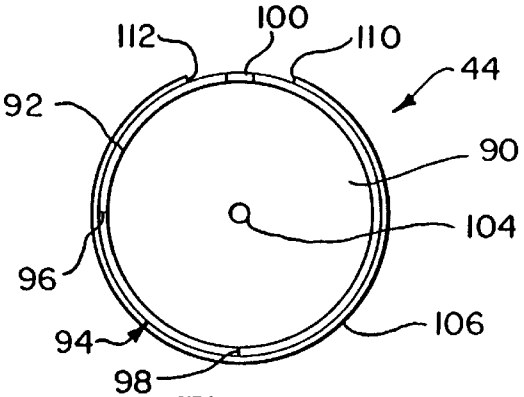
FIG. 7 (PRIOR ART)
FIG. 7 is a front view of the rotary hook assembly component of FIG. 6.
Figure 9:
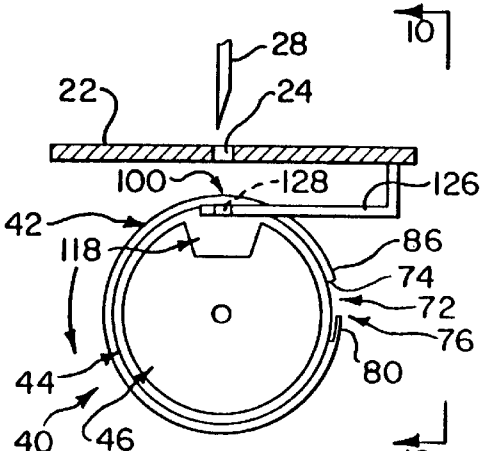
FIG. 9 (PRIOR ART)
FIG. 9 is an enlarged front view of the rotary hook assembly of FIG. 3 mounted to the sewing machine of FIGS. 1 and 2.

With reference to FIGS. 9 and 10, the bobbin case holder 44 (and also the bobbin case 48 in the case holder 44) is held in a stationary position with the needle clearance slot 102 in the bobbin case holder peripheral wall 92 at the 12:00 o'clock location in alignment with and below the needle clearance aperture 24 of the throat plate 22 by means of a bobbin case holder positioning finger 126 which is attached at its proximal end to the throat plate 22. The bobbin case holder positioning finger 126 has a protrusion 128 near its distal end which protrusion 128 is received in the positioning notch 100 in the bobbin case holder peripheral side wall 92 and, thereby, holds the bobbin case holder 44 stationary with the needle clearance slot 102 in the peripheral wall 92 in alignment with and beneath the needle clearance aperture 24 of the throat plate 22 as the hook base 42 rotates in the first direction (for example counter-clockwise as shown).

In forming a "lock stitch" with the sewing machine 10, a strand of needle thread carried by the reciprocating needle 28 is passed downwardly through the fabric material 30 resting on the throat plate 22 and is carried around the bobbin inside the bobbin case holder 44 which is wound with bobbin thread. The needle 28 retracts upwardly pulling the strand of needle thread upwardly into the fabric material 30 carrying a strand of the bobbin thread from the bobbin with it.

As a starting point in the following discussion of the operation of the sewing machine 10, and without reference to any specific Figure, the sewing needle 28 is all the way down at the bottom of its stroke or travel and projects through the fabric material 30 on the throat plate 22, through the needle clearance aperture 24 in the throat plate 22, through the needle clearance slot 102 in the peripheral wall 92 of the bobbin case holder 44, and through the slot 118 in the peripheral wall 116 of the bobbin case 48 pulling a strand of needle thread with it, and the needle thread hook point 78 on the hook base 42 is at the 2:00 o'clock location and moving toward the needle 28 as the hook base 42 rotates in the first or counter-clockwise direction. The distal end 36 of the take-up lever 34 is descending or moving downwardly toward the needle 28 pulling a strand of needle thread from the needle thread supply source 32 to form slack in the strand of needle thread to assist in the formation of a needle thread loop. As the needle 28 moves upwardly, pulling the strand of needle thread within it, the pinching of the strand of needle thread between the needle 28 and the fabric material 30 aids to form a small loop in the needle thread on the scarf side of the needle 28, the distal end 36 of the take-up lever 34 continues downwardly feeding more needle thread to maintain a slack in the strand of needle thread, and the needle thread hook point 78 on the rotating hook base 42 has moved to the 12:00 o'clock location entering the small loop formed in the strand of needle thread. The needle 28 continues to move upwardly as the hook base 42 continues to rotate in the counter-clockwise direction pushing the needle thread hook point 78 all the way through the loop of needle thread such that as the needle thread hook point 78 moves toward the 9:00 o'clock location, the top portion or side of the needle thread loop over the top side of the needle thread hook point 78 has moved in the space between the needle thread hook point 78 and the needle thread deflector point 80 and against the needle thread stop flange 82. The needle thread deflector point 80 contacts the top portion of the needle thread loop over the top side of the needle thread hook point 78 and forces that top portion of the loop of needle thread toward the peripheral free edge of the perimeter side wall 68 of the cylindrical hook base 42. Also, the bottom portion of the needle thread loop under the bottom side of the needle thread hook point 78 passes across the raceway 88 in the hook base perimeter wall 68 which positions the bottom portion of the needle thread loop directly in front of and across the thread detainer point 112 of the rail 106 on the bobbin case holder peripheral side wall 92. The distal end 36 of the take-up lever 34 continues to move downwardly continuing to pull needle thread with it to supply additional needle thread to the needle thread hook point 78 on the rotating cylindrical hook base 42, and the needle 28 is rising or moving upwardly out of the needle clearance aperture 24 of the throat plate 22. As the cylindrical hook base 42 continues to rotate counter-clockwise, the needle 28 is rising or moving upwardly and out of the fabric material 30 being stitched on the top side of the throat plate 22, the distal end 36 of the take-up lever 34 continues to move downwardly pulling more needle thread with it and, therefore, supplying more needle thread to the rotary hook assembly 40. The needle thread stop flange 82 of the rotating hook base 42 moves the bottom or underside portion of the needle thread loop into engagement with the thread detainer point 112 of the rail 106 on the stationary bobbin case holder 44 (which thread detainer point 112 acts as a pivot point about which the bottom or underside portion of the needle thread loop subsequently will move) and starts to draw or pull the needle thread loop around the bobbin case holder 44 enlarging the size of the needle thread loop so that the needle thread loop can completely encircle the bobbin case holder 44. As the hook base 42 continues to rotate counter-clockwise moving the needle thread hook point 78 toward, for example, the 5:00 o'clock position, the needle thread loop has slipped off the hook base needle thread deflector point 80 so that the enlarged needle thread loop is now transversely looped or transversely encircles the bobbin case holder 44, with the back portion of the enlarged needle thread loop extending transversely across the back side face of the bobbin case holder 44 at the interface of the bobbin case holder back wall 90 and the hook base back wall 66, and the front portion of the enlarged needle thread loop extending transversely across the front side face of the bobbin case holder 44 over the exterior surface of the front wall 114 of the bobbin case 46. Therefore, the enlarged needle thread loop now transversely encircles the bobbin case holder 44 from the 6:00 o'clock location of the bobbin case holder 44 to the 12:00 o'clock location of the bobbin case holder 44. At this time, the distal end 36 of the take-up lever 34 has moved to the bottom of its movement. The hook base 44 continues to rotate counter-clockwise moving the rotary hook needle thread hook point 78 back to the starting point at the 2:00 o'clock location making one complete revolution, and the needle 28 is at the top of its stroke or upward movement. At this time, the needle thread loop has pulled out of the space between the hook base needle thread hook point 78 and the hook base needle thread deflector point 80 and off the hook base needle thread hook point 78. The distal end 36 of the needle thread take-up lever 34 has now changed direction of movement and is now rapidly moving back upwardly twice as fast as it moved in the downstroke. The rapidly upwardly moving distal end 36 of the take-up lever 34 pulls the needle thread loop away from and off of the hook base needle thread hook point 78, out of the positioning notch 100 of the bobbin case holder perimeter wall 92, and into engagement with the oppositely facing hook base thread retainer point 86 of the hook base 42. As the hook base 42 continues to rotate in the counter-clockwise direction starting a second revolution moving the hook base needle thread hook point 78 toward the 12:30 location, the needle 28 is again moving downwardly from the top of its stroke, and the distal end 36 of the needle thread take-up lever 34 is still rapidly moving upwardly away from the needle 28. The needle thread take-up lever 34 pulls the needle thread loop out of the bobbin case holder positioning notch 100 in the bobbin case holder perimeter wall 92, and off the release point 110 of the bottom case holder rail 106 so that the needle thread loop is also pulled out from behind the bobbin case holder rail 106 and the thread loop is momentarily held on the hook base thread retainer point 86 of the rotating hook base 42. As the hook base 42 continues to rotate in the counter-clockwise direction, moving the hook base needle thread hook point 78 to the 12:00 o'clock location, the needle 28 is still moving downwardly, and the distal end 36 of the needle thread take-up lever 34 is still moving upwardly. The upwardly moving needle thread take-up lever 34 pulls the needle thread loop off hook base thread retainer point 86 and upwardly through the needle clearance aperture 24 of the throat plate 22 against the underside of the fabric material 30 on the top side of the throat plate 22. The needle thread being pulled upwardly by the needle thread take-up lever 34 carries the bobbin thread up with it. The hook base 42 continues to rotate in the counter-clockwise direction moving the hook base needle thread hook point 78 to the 10:30 location, the needle 28 continues to move downwardly toward the throat plate 22, and the distal end 36 of the take-up lever 34 is moving to the top of its travel to pull the interlocked needle thread and bobbin thread into the underside of the fabric material 30 setting a "lock stitch". During the balance of this second revolution of the hook base 42 moves the needle thread hook point 78 back to the 2:00 o'clock location, the needle 28 moves downwardly and the distal end 36 of the take-up lever 34 moves downwardly to pull a length of needle thread from the source 32 of needle thread to replace the length of needle thread used in making the previous "lock stitch", but during this second revolution of the hook base needle thread hook point 78 does not engage and, therefore, does not carry any needle thread with it. In other words, this second rotation of the hook base 42 provides an idle period for the operation of the hook base 42 to give the needle 28 time to return to the bottom of its stroke and return the hook base needle thread hook point 78 back to the 2:00 o'clock position preparatory to a repetition of the above steps forming the next needle thread loop and next "lock stitch".

It should be noted that in the above-discussed prior-art sewing machine 10 that the distal end 36 of the take-up lever 34 travels up and down in an elliptical path. The elliptical path is necessary in the prior-art sewing machine 10 to, firstly, allow the take-up lever 34 to pull needle thread slowly from the needle thread source 32, and deliver the length needle thread to the hook base needle thread hook point 78 on the downstroke of the lever 34, and also, secondly, to pull the needle thread loop rapidly away from the rotating hook base 42 in order to pull the needle thread loop off the hook base needle thread hook point 78 and set the "lock stitch" in the fabric material 30. In the prior-art sewing machine, in order to accomplish these functions, the distal end 36 of the lever arm 34 must travel about twice as fast on its upstroke as it does on its downstroke so that the lever arm 34 will pull the needle thread loop off the hook base needle thread hook point 78 and set the "lock stitch" in the fabric material 30 as the needle 28 moves downwardly toward the hook base 42 but before the needle 28 reaches the needle clearance aperture 24 of the throat plate 22 to prevent the needle 28 from engaging the needle thread loop being pulled from the hook base needle thread hook point 78. In addition, in order to accomplish these functions in the prior-art sewing machine 10 the hook base 42 must make two revolutions for each cycle of the needle 28. As described above, the first revolution of the hook base 42 is used to feed needle thread to the hook base 42, and form the needle thread loop encircling the bobbin case holder 44, and the second revolution is functionally an idle revolution during which the hook base 42 does not perform any function, but is required (1) to allow time for the lever arm 34 to continue to move upwardly to the top of its movement to pull the needle thread loop from its position encircling the bobbin case holder 44 and upwardly through the thread plate needle clearance aperture 24 of the throat plate 22, and set the "lock stitch" in the fabric material 30 on the top of the throat plate 22, (2) to allow time for the lever arm 34 to reverse its direction of movement downwardly to pull another length of needle thread from the needle thread source 32 for formation of the next needle thread loop by the hook base 42, and (3) to allow time for the needle 28 to return to the downward-most position of its downward travel in preparation in forming the next needle thread loop during the subsequent loop-forming revolution of the hook base 42. Therefore, in order for the prior-known sewing machine 10 to operate forming "lock stitches" in the fabric material 30 the needle 28 moves up and down once (one cycle) per every two revolutions of the cylindrical hook base 42 of the rotary hook assembly 40, and, therefore to operate at a sufficient production rate, the rotary hook base 42 must be rotated at high speeds, for example, up to 12,000 r.p.m.

The present invention provides an improved sewing machine for forming "lock stitches" of the known type in a fabric material 30 in which the hook base 42 makes one revolution per each cycle of the needle 28 thereby saving wear on the components of the sewing machine, allowing the improved sewing machine to operate at slower speeds than the prior-art sewing machine 10 while producing the same number of "lock stitches" during the same operating tine period, or allowing the improved sewing machine to operate at the same speeds as the prior-art sewing machine 10 while producing a greater number of "lock stitches" during the same operating time period.

Figure 11:
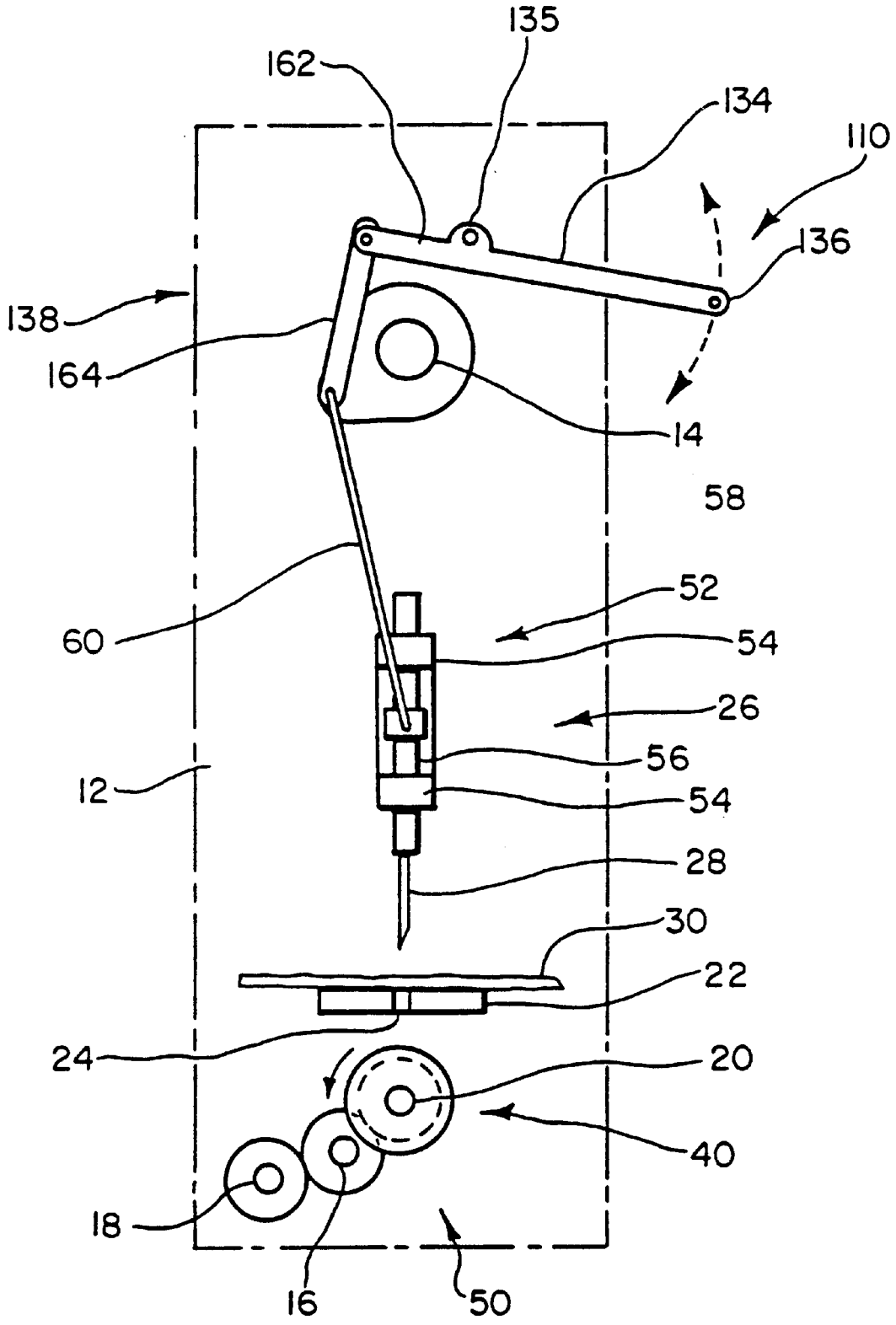
FIG. 11 is a front view of a sewing machine similar to FIG. 2 showing a novel needle thread take-up lever mechanism of the present invention.
Figure 12:
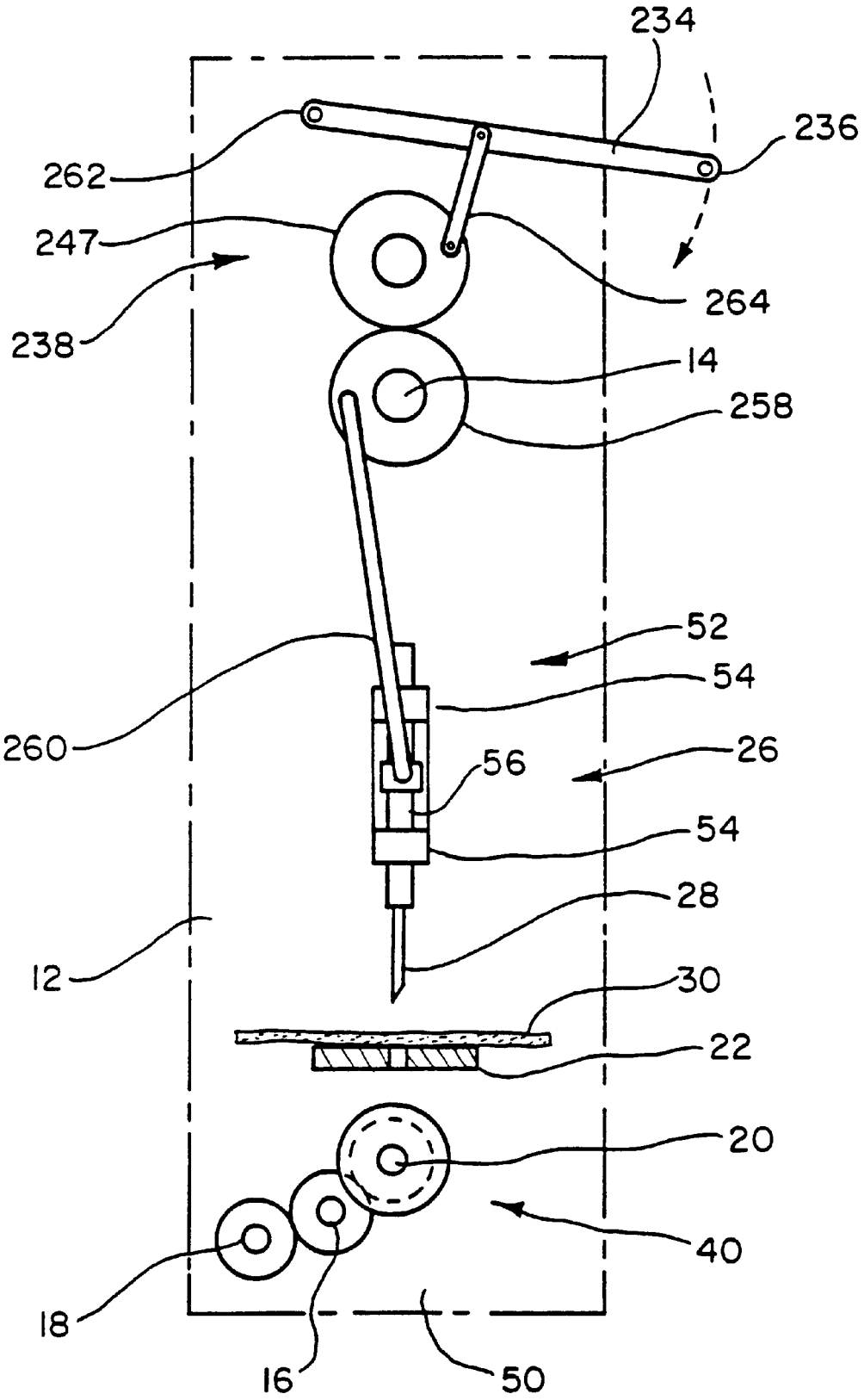
FIG. 12 is a front view of a sewing machine similar to FIG. 2 showing another novel needle thread take-up lever mechanism of the present invention.

With reference to FIGS. 11 and 12, there is shown in schematic format, a sewing machine, generally denoted as the 110 of the present invention, for sewing a stitch line in a fabric. More particularly, the sewing machine 110 forms a known stitch that interlocks a needle thread with a bobbin thread, commonly referred to in the industry as a "lock stitch".

Sewing machine 110 has many components in common with the prior-art sewing machine 10, and these common components are identified by identical numbers. The sewing machine 110 includes the conventional frame 12 top main drive shaft 14, bottom main drive shaft 16, the walking dog shaft 18, the rotary hook assembly drive shaft 20, having a throat plate 22, formed with a needle-receiving aperture 24 therethrough and supply source 32 of needle thread.

In the sewing machine 110, a known, conventional cylindrical rotary hook assembly 40 is located beneath the throat plate 22 in alignment with the throat plate needle clearance aperture 24. As discussed above, the conventional rotary hook assembly 40 is comprised of three components: a cylindrical hook base 42, a cylindrical basket or bobbin case holder 44 concentrically disposed in the hook base 42 for holding a bobbin of bobbin thread, and a bobbin case 48 concentrically mounted disposed with the bobbin case holder 44 for holding the bobbin 46 in position in the bobbin case holder 44. The rotary hook assembly 40, and more particularly the cylindrical hook base 42, is mounted to the rotary hook assembly drive shaft 20 for rotation in a first rotational direction (for example counter-clockwise) in timed relationship with the reciprocation of the needle 28 and arcuate motion of the distal end 36 of a novel needle thread take-up lever 134 to be hereinafter discussed.

With reference to FIG. 11, there is shown (in schematic format) a preferred embodiment of a needle holding and reciprocating means 26 which can be used with the sewing machine 110 of the present invention. As in the prior-art, the needle bar walker frame 52 is pivotally attached to the frame 12 and includes needle bar receiving collars 54. The needle bar 56 is coaxially received through the needle bar receiving collars 54 for longitudinal reciprocal movement therein in the downward direction and in the upward direction. The needle 28 is mounted to the depending end of the needle bar 56 for movement with the needle bar 56. The eccentric 58 is mounted to the end of the top main drive shafts 14 of the sewing machine 110 projecting from the front of the frame 12 for rotation therewith. The needle bar 56 is interconnected to the eccentric 58 by the connecting rod 60, which is pivotally attached at one end to the eccentric 58 and pivotally attached at its other end to the needle bar 56. As in the prior-art, the rotation of the eccentric 58 is transferred to the needle bar 56 and translated into linear motion of the needle bar 56 by the connecting rod 60. With continued reference to FIG. 11, a needle thread take-up lever 134 of the present invention is pivotally attached at a point identified in the Figure as reference numeral 135 to the frame 12 between its distal end 136 and its interior or proximal end 162 above the eccentric 58, and is disposed so that the lever proximal end 136 projects beyond the side of the frame 12. Needle thread take-up lever moving means 138 interconnects the eccentric 58 to the needle thread take-up lever 134 and includes a connecting link 164 which is pivotally connected at one end to the eccentric 58 coaxial with the pivotal connection of the connecting rod 60 to the eccentric 58 and pivotally connected at its other end to the needle thread take-up lever 134 at the take-up lever interior or proximal end 162. This configuration of the needle thread takeup lever 134 results in the distal or projecting end 136 of the take-up lever 134 moving in an arcuate path as opposed to the elliptical path of distal end 36 of the prior-art take-up lever 34, and further provides for the projecting end 136 moving upwardly in the arcuate path at the same speed as it does in moving downwardly in the arcuate path as opposed to the prior-art needle thread liner 34 wherein the distal end 36 of the take-up lever 34 moves upwardly at twice the speed at which it moved downwardly.

With reference to FIG. 12, there is shown (in schematic format) another embodiment of a needle holding and reciprocating means 26 which can be used with the sewing machine 110 of the present invention. As in the prior art, the needle bar walker frame 52 is pivotally attached to the frame 12 and includes needle bar-receiving collars 54. The needle bar 56 is coaxially received through the needle bar-receiving collars 54 for longitudinal reciprocal movement therein in a downward direction and in an upward direction. The needle 28 is mounted to the depending end of the needle bar for movement with the needle bar 56. A driving gear 258 is mounted to the end of the top main drive shaft 14 of the sewing machine 110 projecting from the front of the frame 12 for rotation therewith. The needle bar 56 is interconnected to the driving gear 258 by a connecting rod 260, which is pivotally attached at one end to the driving gear 258 radially spaced from the top main drive shaft 14 and pivotally attached at its other end to the needle bar 56. Rotation of the driving gear 258 is transferred to the needle bar 56 and translated into linear notion of the needle bar 56 by the connecting rod 260. With continued reference to FIG. 12, a needle thread take-up lever 234 of the present invention is pivotally attached to the frame 12 at a proximal end 262 above the driving gear 258, and is disposed so that the distal end 236 projects beyond the side of the frame 12. Needle thread take-up lever moving means 238 interconnects the driving gear 258 to the needle thread take-up lever 234. The take-up lever moving means 238 includes a driven gear 247 rotatably mounted to the frame 12 above the driving gear 258 and in mesh with the driving gear 258, and a connecting link 264 which is pivotally connected at one end to the driven gear 247 radially spaced from the pivot axis of the driven gear 247 and pivotally connected at its other end to the needle thread take-up lever 234 between the lever ends 236 and 262.

With reference to FIGS. (13–20), one embodiment of the present invention further includes means 326 for oscillating the bobbin case holder 44, and the bobbin case 48 held inside the bobbin case holder 44, in unison first in a rotational direction from an initial position whereat the bobbin case holder 44 is oriented with the positioning finger receiving notch 100 and the needle clearance slot 102 in the perimeter side wall 92 of the bobbin case holder 44 at the 12:00 o'clock location, to a second position in a clockwise direction from the initial position (i.e. in the opposite rotational direction to the counter-clockwise rotation of the cylindrical hook base 42) and then back to the initial position in timed relationship to the position of the needle 28 and rotational position of the rotating hook base 42. For example, in the above discussion, the hook base 42 rotates counter-clockwise and the bobbin case holder oscillating means 326 pivots the assembly of the bobbin case holder 44 and bobbin case 48 through a predetermined arc less than 360° in a clockwise direction. The reason for pivoting the bobbin case holder 44 and the bobbin case 48 in the clockwise direction is to move the release point 110 of the rail 106 on the perimeter wall 92 of the bobbin case holder 44 in a clockwise direction through a predetermined angular displacement so as to provide for the release of the needle thread loop from its position across the rail 106 of the bobbin case holder 44 and allowing the take-up lever 134, 234 to pull the needle thread loop out of the bobbin case holding position notch 100 and out from behind the bottom case holder rail 106 earlier in time than it is released in the known sewing machine 10 and, therefore, allowing the upwardly moving lever arm 134, 234 to pull the needle thread loop upwardly through the needle clearance aperture 24 of the throat plate 22 against the underside of the fabric material 30 setting the "lock stitch" much earlier in time than in the prior-art sewing machine 10.

Figure 14:
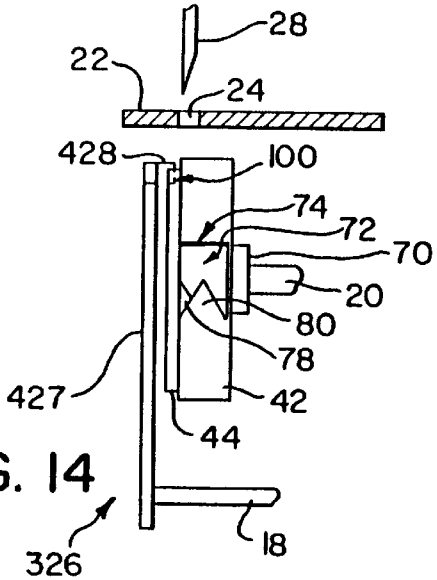
FIG. 14 is a side view as seen in the direction of arrows 14—14 in FIG. 13.
Figure 13:
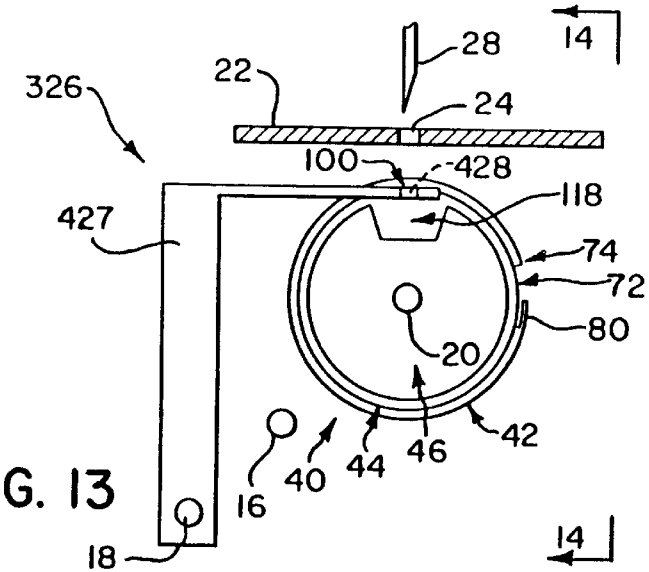
FIG. 13 is an enlarged front view of a novel oscillating device of the present invention associated with the rotary hook assembly mounted to the sewing machine.

With reference to FIGS. 13 and 14, in one embodiment, the bobbin case holder oscillating means 326 comprises a lever arm 427 mounted at its proximal end to the walking dog oscillating drive shaft 18 of a conventional sewing machine for oscillating movement therewith. The lever arm 427 has a finger 428 projecting outwardly from one side of the lever arm 427 near the distal end of the lever arm 427. The lever arm 427 projects across the front of the hook assembly 40 and the finger or protrusion 428 is received in the positioning finger receiving notch 100 in the perimeter side wall 92 of the bobbin case holder 44. Therefore, as the walking dog oscillating drive shaft 18 oscillates, the lever arm 427 also oscillates causing the bobbin case holder 44 to oscillate as discussed above.

Figure 16:
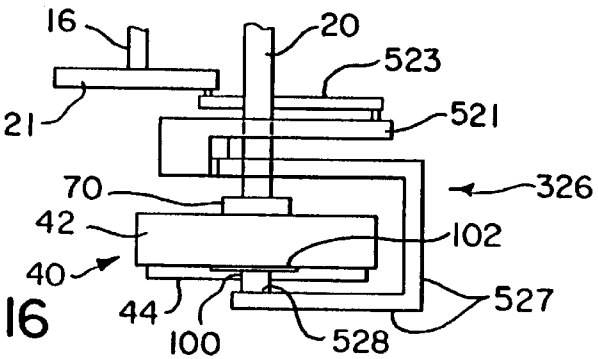
FIG. 16 is a top view as seen in the direction of arrows 16—16 in FIG. 15.
Figure 15:
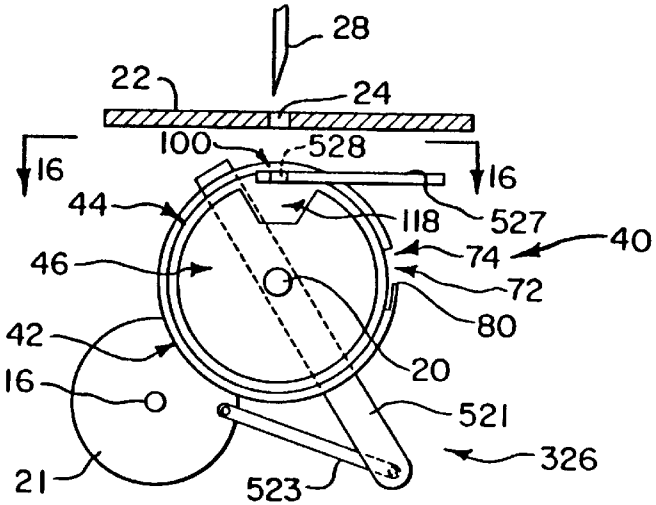
FIG. 15 is an enlarged front view of another novel oscillating device of the present invention associated with the rotary hook assembly mounted to the sewing machine.
Figure 20:
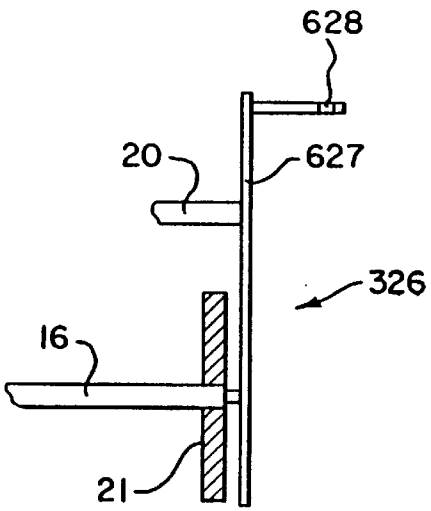
FIG. 20 is a side view as seen in the direction of arrows 20—20 in FIG. 19.
Figure 19:
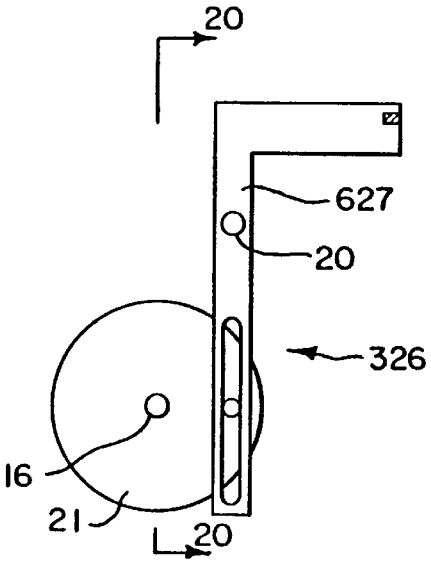
FIG. 19 is a front view as seen in the direction of arrows 19—19 in FIG. 18.
Figure 17:
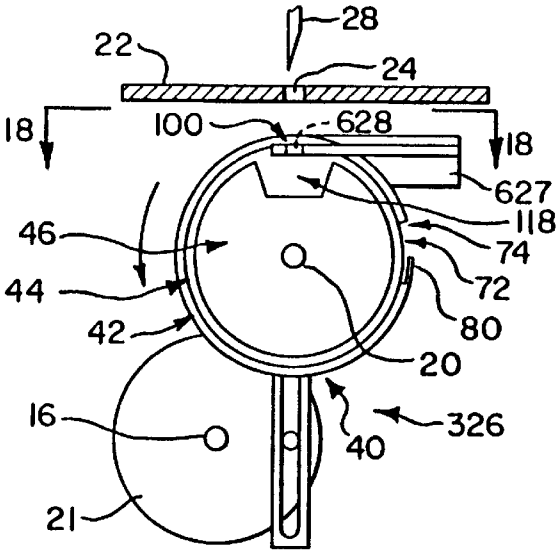
FIG. 17 is an enlarged front view of still another novel oscillating device of the present invention associated with the rotary hook assembly mounted to the sewing machine.
Figure 18:
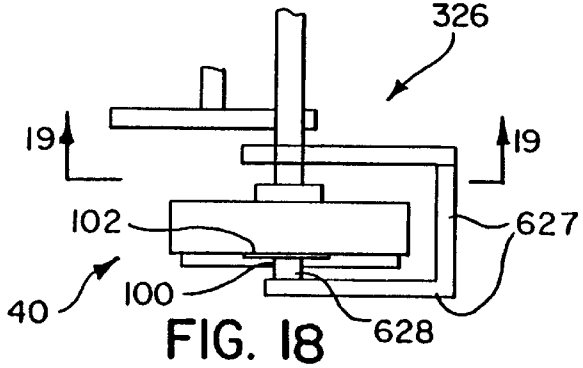
FIG. 18 is a top view as seen in the direction of arrows 18—18 in FIG. 17.
Figure 23:
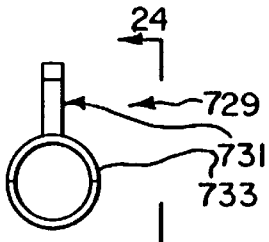
FIG. 23 is a front view of the sweep arm device of FIGS. 22 and 23.

With reference to FIGS. 15 and 16, in another embodiment, the bobbin case holder oscillating means 326 comprises a first link 521 journal mounted at its proximal end and distal end to the rotary hook assembly drive shaft 20, a second link 523 pivotally mounted at its proximal end to the hook assembly shaft drive gear 21 on the sewing machine main drive shaft 16 eccentric to the sewing machine bottom main drive shaft 16, the distal end of the first link 521 being pivotally interconnected with the distal end of the second link 523, and a lever arm 527 connected to the proximal end of the first link 521. The lever 527 has a finger or protrusion 528 projecting outwardly from one side of the lever arm 527 near the distal end of the lever 527. The lever arm 527 extends across the front of the rotary hook assembly 40 and the finger or protrusion 528 received in the bobbin case holder positioning finger receiving notch 100 of the bobbin case holder 44. Therefore, as the hook assembly shaft drive gear 21 rotates with the sewing machine bottom main drive shaft 16, and due to the eccentric mounting of the second link 523 to the hook assembly shaft drive gear 21, the first lever 521 oscillates on the rotary hook assembly shaft 20 causing the bobbin case holder 44, and the bobbin case 48 mounted in the bobbin case holder 44, to oscillate as discussed above.

With reference to FIGS. 17 through 20, the bobbin case holder oscillating means 326 according to a preferred embodiment of the present invention comprises a lever arm 627 journal mounted between its ends to the rotary hook assembly drive shaft 20. The lever arm 627 is pivotally attached at its proximal end to the hook assembly shaft drive gear 21 on the sewing machine bottom main drive shaft 16 eccentric to the sewing machine bottom main drive shaft 16. The lever arm 627 has a finger or protrusion 628 projecting outwardly from one side of the lever arm 627 near the distal end of the lever arm 627. The distal end of the lever arm 627 projects across the front of the rotary hook assembly 40 and the finger 628 is received in the bobbin case holder positioning finger notch 100 of the bobbin case holder 44. Therefore, as the hook assembly shaft drive gear 21 rotates with the sewing machine bottom main drive shaft 16, and due to the eccentric mounting of the proximal end of the lever arm 627 to the hook assembly shaft drive gear 21, the distal end of the lever arm 627 oscillates about the hook assembly drive shaft 20 causing the bobbin case holder 44, and the bobbin case 48 mounted in the bobbin case holder 44, to oscillate as discussed above.

FIGS. 21–24 and 25–26 illustrate two additional embodiments of a needle thread loop sweep means, generally denoted as the numeral 729, which rotates with the hook base 42 of the hook assembly 40. The needle thread loop sweep means 729 engages the needle thread loop immediately after the needle thread loop is released from its position across the bobbin case holder 44 and as the needle thread take-up lever 134, 234 begins to pull the needle thread loop upwardly, and to push or sweep the needle thread loop away from the needle 28 to the rear so that the needle thread loop will clear the needle 28. If the needle 28 physically interferes with the needle thread loop as it is being pulled upwardly by the take-up lever 134, 234 to the fabric to form the "lock stitch", the needle thread loop could wrap around the needle 28.

With reference to FIGS. 21 through 24, the needle thread loop sweep means 729 is shown as an arm 731 which is secured at its proximal end to the rotary hook assembly drive shaft 20 for rotation therewith. Toward this objective, a sweep arm mounting collar 733 is concentrically located over the rotary hook assembly drive shaft 20 behind the hook base 42, and the thread loop sweep arm 731 is attached at its proximal end to the mounting collar 733 and extends generally parallel to the longitudinal axis of the rotary hook assembly drive shaft 20, and, therefore, parallel to the axis of rotation of the cylindrical hook base 42, past the perimeter of the cylindrical hook assembly 40 such that the distal end of the thread loop sweep arm 731 projects past the front side of the rotary hook assembly 40. The sweep arm mounting collar 733 can be a split collar with the collar ends secured together by a fastener or set screw threaded into threaded apertures in the collar 733 against the hook assembly drive shaft 20 to hold the collar 733 in position on the hook assembly drive shaft 20. This would also provide for adjusting the location of the needle thread sweep arm 731 around the drive shaft 20 circumferentially of the hook case 42 by merely moving the collar 733 about the shaft 20. As shown, the needle thread loop arm 731 is positioned relative to the circumference of the hook case 42 so that the loop arm 731 is approximately adjacent the first end 74 of the gap 72 in the perimeter side wall 68.

Figure 26:
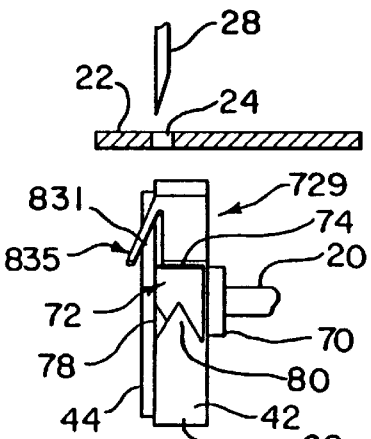
Figure 22:
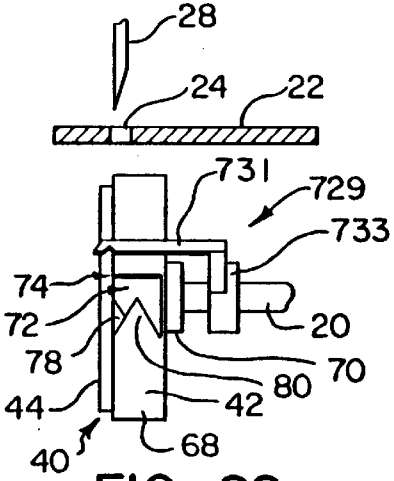
FIG. 22 is a side view as seen in the direction of arrows 22—22 in FIG. 21.
Figure 25:
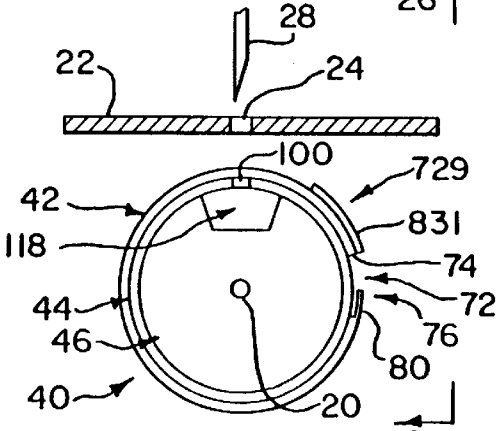
FIG. 25 is a front view of another novel needle thread sweep device of the present invention associated with the rotary hook assembly mounted to the sewing machine; and, FIG. 26 is a side view as seen in the direction of arrows 26—26 in FIG. 25.
Figure 21:
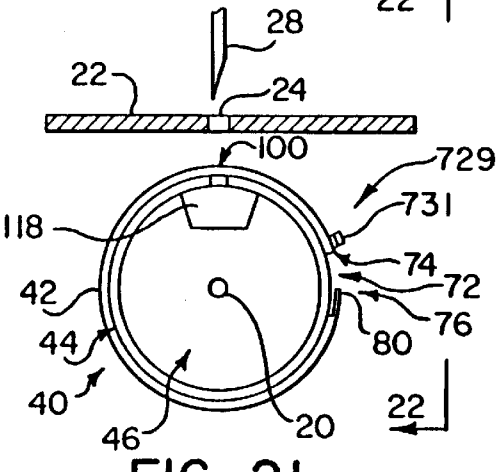
FIG. 21 is a front view of a novel needle thread sweep device of the present invention associated with the rotary hook assembly mounted to the sewing machine.
Figure 24:
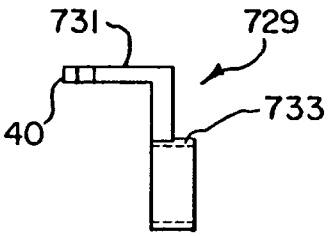
FIG. 24 is a side view as seen in the direction of arrows 24—24 in FIG. 23.

With reference to FIGS. 25 and 26, the needle thread loop sweep means 729 is shown as an arm 831 mounted to the perimeter side wall 68 of the hook base 42 approximate the first end 74 of the gap 72. The arm 831 projects past the front side of the rotary hook assembly 40. The leading edge 835 of the arm 831 tapers from the front edge of the perimeter wall 68 to the distal end of the arm 831 to provide a smooth transmission from the proximal end of the arm 831 to the distal end of the arm.

As a starting point in the following discussion of the sewing machine 110, and without reference to any specific //fig, the sewing needle 28 is moving downwardly and is positioned through the fabric 30, through the aperture 24 in the plate 22, and is entering the needle clearance slot 102 in the perimeter side wall 92 of the bobbin case holder 44, the needle thread hook point 78 of the hook base 42 is at about the 2:00 o'clock location and moving toward the needle 28 as the hook base 42 rotates in the first or counter-clockwise direction, and the needle thread sweep means 729 is positioned adjacent the needle 28 but to the opposite side of the needle 28 from the hook point 78 or, for example, at about the 11:00 position. The distal end 136, 236 of the needle thread take-up lever 134, 234 is at the top of its stroke and is about to move back downwardly toward the needle 28 causing a needle thread loop to form. The case holder oscillating means 326 previously rotated the bobbin case 48 clockwise to the extent of its clockwise rotation so that the bobbin case holder positioning notch 100 and the needle clearance slot 102 in the perimeter wall 92 of the bobbin case holder 44 are at, for example, about the 1:00 o'clock position and the oscillating means 326 is beginning to rotate the bobbin case holder 44 in a counter-clockwise direction back toward the 12:00 o'clock position. The needle 28 continues moving downwardly until it is all the way down and projects into the needle clearance slot 102 in the perimeter side wall 92 of the bobbin case holder 44 and needle clearance slot 118 in the perimeter side wall 116 of the bobbin case 48, the bobbin case 48 has been rotated counter-clockwise by the oscillating means 326 so that the bobbin case holder positioning notch 100 and needle thread clearance slot 102 are at the 12:00 o'clock position, and the needle thread hook point 78 of the hook base 42 is at about the 12:00 o'clock location about to enter the small needle thread loop being formed. The distal end 136, 236 of the needle thread take-up lever 134, 234 is beginning to move downwardly pulling needle thread from the needle thread supply source 32. The needle 28 continues to move upwardly and is still in the needle-receiving aperture 24 of the throat plate 22 as the hook base 42 continues to rotate in the counter-clockwise direction to about the 11:00 o'clock location pushing the needle thread hook point 78 all the way through the needle thread loop and the distal end 136, 236 of the needle thread take-up lever 134, 234 continues moving downwardly feeding more needle thread to the rotary hook assembly 40, and more particularly to the needle thread hook point 78 of the hook base 42. The needle 28 continues to move upwardly as the hook base 42 continues to rotate in the counter-clockwise direction such that as the needle thread hook point 78 moves toward the 9:00 o'clock location, the top portion or side of the needle thread loop over the top side of the needle thread hook point 78 has moved all the way into the space between the needle thread hook point 78 and the needle thread deflector point 80 and against the needle thread stop flange 82. The needle thread deflector point 80 contacts the top portion of the needle thread loop over the top side of the needle thread hook point 78 and forces that top portion of the loop of needle thread toward the peripheral edge of the perimeter side wall 68 of the hook base 42. Also, the bottom portion of the needle thread loop under the bottom side of the needle thread hook point 78 passes across the raceway 88 in the hook base perimeter wall 68 which positions the bottom portion of the needle thread loop in front of and across the thread detainer point 112 of the rail 106 of the bobbin case holder perimeter side wall 92. The distal end 136, 236 of the take-up lever 134, 234 continues to move downwardly continuing to pull needle thread with it to supply additional needle thread to the needle thread hook point 78 on the rotating cylindrical hook base 42, the needle 28 is rising or moving upwardly out of the needle clearance aperture 24 of the throat plate 22, and bobbin case holder reciprocating means 326 begins to rotate the bobbin case 44 clockwise which moves the detainer point 112 of the rail 106 of the bobbin case holder perimeter wall 92 clockwise toward and into engagement with the bottom portion of the needle thread loop moving counter-clockwise with the needle thread hook point 78. The thread detainer point 112 acts as a pivot point about which the bottom or underside portion of the needle thread loop moves and the detainer point 112 starts to draw or pull the needle thread loop around the bobbin case holder 44 enlarging the size of the needle thread loop so that the needle loop can completely encircle the bobbin case holder 44. As the cylindrical hook base 42 continues to rotate counter-clockwise moving the needle hook point 78 toward about the 7:30 location, the needle 28 is rising or moving upwardly and out of the fabric material 30 being stitched on the top side of the throat plate 22, the distal end 136, 236 of the take-up lever 134, 234 continues to move downwardly pulling more needle thread with it and, therefore, supplying more needle thread to the rotary hook assembly 40, and the bobbin case holder reciprocating means 326 continues to rotate the bobbin case holder 44 clockwise so that the detainer point 112 on the bobbin case holder rail 106 enlarges the needle thread loop. As the hook base 42 continues to rotate counter-clockwise moving the needle hook point 78 to about the 6:00 location, the needle thread loop has slipped off the hook base needle thread deflector point 80 so that the enlarged needle thread loop is transversely looped or transversely encircles the bobbin case holder 44, with the back portion of the enlarged needle thread loop extending transversely across the back side face of the bobbin case holder 44 at the interface of the bobbin case holder back wall 90 and the hook base back wall 66, and the front portion of the enlarged needle thread loop extending transversely across the front side of the bobbin case in the bobbin case holder 44. Therefore, the enlarged needle thread loop now transversely encircles the bobbin case holder 44 from the 6:00 o'clock location of the case holder 44 to the 12:00 o'clock location of the bobbin case holder 44. At this time, the distal end 136, 236 of the take-up lever 134, 234 has moved to the bottom of its stroke or movement, and the needle 28 is at the top of its stroke or upward movement. The hook base 42 continues to rotate counter-clockwise moving the needle thread hook point 78 to about the 5:00 o'clock location at which time the needle 28 is now moving back down. The bobbin case holder reciprocating means 326 has rotated the bobbin case holder 44 clockwise to its fullest extent such that the bobbin case holder positioning finger-receiving notch 100 of the bobbin case holder 44 and also the first end or release point 110 of the bobbin case holder rail 106 are at, for example, about the 2:00 o'clock location. The distal end 136, 236 of the needle thread take-up lever 134, 234 has changed direction of movement and is now moving back upwardly at the same speed as it would in the downward stroke. The upwardly moving distal end 136, 236 of the take-up lever 134, 234 pulls the needle thread loop off the release point 110 of the bobbin case holder rail 106 so that the needle thread loop is also beginning to be pulled out from behind the bobbin case holder rail 106. The hook base 42 continues to rotate counter-clockwise moving the rotary hook needle thread hook point 78 toward about the 3:00 o'clock location, the needle 28 has moved back down to the throat plate 22, the needle thread loop sweep means 729 has moved with the hook base 42 to about the 12:00 o'clock location, and the distal end 136, 236 of the take-up lever 134, 234 is still moving upwardly. The upwardly moving needle thread take-up lever 134, 234 pulls the needle thread loop upwardly out from behind the bobbin case holder 44 and upwardly toward the needle clearance aperture 24 of the throat plate 22 as the needle thread loop sweep means 729 pushes or sweeps the needle thread loop being pulled by the take-up lever 134, 234 away from the descending needle 28. The needle thread being pulled upwardly by the needle thread take-up lever 134, 234 carries the bobbin thread with it. As the hook base 42 continues to rotate counter-clockwise moving the needle thread hook point 78 toward, for example, the 2:00 o'clock location, the take-up lever 134, 234 has moved to the top of its travel pulling the interlocked needle thread and bobbin thread through the aperture 24 of the throat plate 24 into the underside of the fabric material 30 setting the "lock stitch" in the fabric material. When the hook base 42 has rotated to locate the hook point 78 at about the 2:00 o'clock location, the needle 28 has moved downwardly back through the fabric material 30 and through the aperture 24 of the throat plate 22 but has not yet entered the needle gap 72 of the perimeter wall 68 of the base hook 42, and the bobbin case holder reciprocating means 326 begins to rotate the bobbin case holder 44 counter-clockwise to move the bobbin case holder positioning notch 100 (and, therefore, the needle clearance slot 102 in the perimeter wall 92 of the bobbin case holder 44) back toward the 12:00 o'clock location to begin the formation of another "lock stitch" as discussed above.

It should be noted that the present invention provides for the formation of a "lock stitch" every revolution of the hook base 42 as opposed to the two revolutions of the hook base 42 required by the prior art, provides for the take-up lever arm 134, 234 moving at a similar speed upwardly and downwardly as opposed to the prior art wherein the take-up lever arm 34 must travel about twice as fast on its upward stroke as it does on its downward stroke, and provides for the distal end 136, 236 of the take-up lever 134, 234, moving in an arcuate path as opposed to the orbital path of the distal end 36 of the take-up lever arm 34.

Therefore, the present invention provides a sewing machine which can operate at slower speeds while forming the same number of "lock stitches" as the prior art.

The foregoing detailed description is given primarily for clearness of understanding and no unnecessary limitations are to be understood therefrom for modifications will become obvious to those skilled in the art upon reading this disclosure and may be made without departing from the spirit of the invention and scope of the appended claims.

I claim:

1. A sewing machine, comprising:

a reciprocally-mounted needle bar;

means for reciprocally moving said needle bar up and down;

a reciprocally-mounted needle thread take-up lever having a proximal end and a distal end, said distal end being engageable with a strand of needle thread;

means for reciprocally moving said take-up lever up and down, said distal end of said take-up lever being moveable up and down along an arcuate path in timed relationship with said up and down reciprocal movement of said needle bar, said up and down reciprocal movement of said take-up lever being at a substantially similar speed to said up and down reciprocal movement of said needle bar;

a rotary hook assembly disposed beneath said needle bar, said rotary hook assembly including a rotary cylindrical hook base and a cylindrical bobbin case holder concentrically disposed to said rotary cylindrical hook base;

means for rotating said rotary cylindrical hook base in a first rotational direction in timed relationship with said up and down reciprocal movement of said needle bar and with said up and down reciprocal movement of said take-up lever;

means for oscillating said cylindrical bobbin case holder through a predetermined angle of movement between a first angular position and a second angular position, wherein movement from said first angular position to said second angular position is in a counter-rotational direction relative to said first rotational direction of said rotary cylindrical hook base, and wherein movement from said second angular position to said first angular position is in a common-rotational direction relative to said first rotational direction of said rotary cylindrical hook base, and wherein said first angular position is in timed relationship with a first rotational position of said rotary cylindrical hook base; and, wherein said means for reciprocally moving said take-up lever up and down moves said distal end of said take-up lever up and down through one cycle per one revolution of said rotary cylindrical hook base of said rotary hook assembly.

2. The sewing machine according to claim 1, further comprising means for sweeping said strand of needle thread, said needle thread sweeping means being disposed at a preselected location about a circumference of said rotary cylindrical hook base, said needle thread sweeping means being mounted for rotation with said rotary cylindrical hook base.

3. The sewing machine according to claim 2, wherein said needle thread sweeping means including an arm located at a preselected position about a circumference of said rotary cylindrical hook base, said arm extending substantially parallel to an axis of rotation of said rotary cylindrical hook base beyond a perimeter of said rotary cylindrical hook base, said arm being operatively associated with said means for rotating said rotary cylindrical hook base for rotation with said rotary cylindrical hook base.

4. The sewing machine according to claim 2, wherein said needle thread sweeping means including an arm located at a preselected position about a circumference of said rotary cylindrical hook base, said needle thread sweeping means being fixedly attached to a perimeter of said rotary hook base.

5. The sewing machine according to claim 4, wherein said needle thread sweeping arm projects substantially parallel to an axis of rotation of said rotary cylindrical hook base beyond a front side of said rotary cylindrical hook base.

6. The sewing machine according to claim 5, wherein a leading edge of said needle thread sweeping arm tapers from said front side of said rotary cylindrical hook base to a distal end of said needle thread sweeping arm.

7. The sewing machine according to claim 2, wherein:

said cylindrical bobbin case holder including a discontinuous perimeter arcuate side wall extending circumferentially over a sector of a circle and defining a bobbin thread clearance segmental gap between a first end and a second end of said perimeter arcuate side wall of said cylindrical bobbin case holder, a needle thread and needle clearance slot provided through said perimeter arcuate side wall of said cylindrical bobbin case holder within a region spaced circumferentially from said bobbin thread clearance segmental gap, a bobbin case holder positioning notch provided in said perimeter arcuate side wall of said cylindrical bobbin case holder in substantial alignment with said needle thread and needle clearance slot, and a discontinuous circumferential extending rail projecting radially outwardly from an outer surface of said perimeter arcuate side wall of said cylindrical bobbin case holder, said rail being sized and configured to be received within said circumferential raceway of said side wall of said cylindrical hook base, a first end of said discontinuous rail defining a needle thread loop release point and a second end of said discontinuous rail defining a needle thread loop detainer point, said cylindrical bobbin case holder having a circumference being less than a circumference of said perimeter arcuate side wall of said hook base; and, said needle thread sweeping means being located circumferentially of said discontinuous perimeter arcuate side wall of said rotary cylindrical hook base proximate to said first end of said perimeter arcuate side wall of said rotary cylindrical hook base.

8. The sewing machine according to claim 7, wherein said needle thread sweeping means including an arm located at a preselected position about a circumference of said rotary cylindrical hook base, said arm extending substantially parallel to an axis of rotation of said rotary cylindrical hook base beyond a perimeter of said rotary cylindrical hook base, said arm being operatively associated with said means for rotating said rotary cylindrical hook base for rotation with said rotary cylindrical hook base.

9. The sewing machine according to claim 7, wherein said needle thread sweeping means including an arm located at a preselected position about a circumference of said rotary cylindrical hook base, said needle thread sweeping means being fixedly attached to a perimeter of said rotary hook base.

10. The sewing machine according to claim 9, wherein said needle thread sweeping arm projects beyond a front side of said rotary cylindrical hook base.

11. The sewing machine according to claim 10, wherein a leading edge of said needle thread sweeping arm tapers from said front side of said rotary cylindrical hook base to a distal end of said needle thread sweeping arm.

12. The sewing machine according to claim 1, wherein:

said rotary cylindrical hook base including a discontinuous perimeter arcuate side wall extending circumferentially over a sector of a circle and defining a bobbin thread and needle clearance segmental gap between a first end and a second end of said perimeter arcuate side wall, a circumferentially-facing needle thread loop hook point projecting from said second end of said perimeter arcuate side wall toward said first end of said perimeter arcuate side wall, a circumferentially-facing needle thread deflector point projecting from said second end of said perimeter arcuate side wall facing toward said first end of said perimeter arcuate side wall, and a circumferential raceway provided within said perimeter arcuate side wall, said needle thread deflector point being overlapping and radially outwardly spaced from said needle thread hook point, said needle thread deflector point cooperating with and said needle thread hook point to define a needle thread stop disposed within a radial space defined by said needle thread deflector point and said needle thread hook point;

said cylindrical bobbin case holder including a discontinuous perimeter arcuate side wall extending circumferentially over a sector of a circle and defining a bobbin thread clearance segmental gap between a first end and a second end of said perimeter arcuate side wall of said cylindrical bobbin case holder, a needle thread and needle clearance slot provided through said perimeter arcuate side wall of said cylindrical bobbin case holder within a region spaced circumferentially from said bobbin thread clearance segmental gap, a bobbin case holder positioning notch provided in said perimeter arcuate side wall of said cylindrical bobbin case holder in substantial alignment with said needle thread and needle clearance slot, and a discontinuous circumferential extending rail projecting radially outwardly from an outer surface of said perimeter arcuate side wall of said cylindrical bobbin case holder, said rail being sized and configured to be received within said circumferential raceway of said side wall of said cylindrical hook base, a first end of said discontinuous rail defining a needle thread loop release point and a second end of said discontinuous rail defining a needle thread loop detainer point, said cylindrical bobbin case holder having a circumference being less than a circumference of said perimeter arcuate side wall of said hook base; and, said means for oscillating said cylindrical bobbin case holder is engageable with said bobbin case holder positioning notch of said perimeter side wall of said bobbin case holder.

13. The sewing machine according to claim 1, wherein:

said sewing machine further including a walking dog oscillating drive shaft; and, said means for oscillating said cylindrical bobbin case holder including a lever arm having a distal end and a proximal end and means for engaging said bobbin case positioning notch of said side wall of said bobbin case holder, said positioning notch engaging means being proximate to said distal end of said lever arm, said lever arm being mounted to said walking dog oscillating drive shaft at said proximal end for simultaneous movement with said walking dog drive shaft, said distal end projecting across a front of said bobbin case holder.

14. The sewing machine according to claim 1, wherein:

said sewing machine further including a main drive shaft and a rotary hook assembly drive shaft, said rotary hook assembly being mounted on said rotary hook assembly, drive shaft; and, said means for oscillating the cylindrical bobbin case holder including a first link being journal-mounted to said rotary hook assembly drive shaft between a distal end and a proximal end thereof, a second link being pivotally connected at a distal end thereof to said distal end of said first link, a lever arm being fixedly connected at a proximal end thereof to said proximal end of said first link, and means for engaging said bobbin case positioning notch of said side wall of said bobbin case holder, said second link being pivotally eccentrically connected at a proximal end thereof to said main drive shaft, said positioning notch engaging means being proximate to said lever arm distal end.

15. The sewing machine according to claim 1, wherein:

said sewing machine further including a main drive shaft and a rotary hook assembly drive shaft, said rotary hook assembly being mounted on said rotary hook assembly drive shaft; and, said means for oscillating said cylindrical bobbin case holder including a lever arm being journal-mounted to said rotary hook assembly drive shaft between a distal end and a proximal end thereof and means for engaging said bobbin case positioning notch of said side wall of said bobbin case holder, said lever arm distal end projecting across a front of said bobbin case holder, said lever arm proximal end being pivotally attached eccentrically to said main drive shaft, said positioning notch engaging means being proximate to said lever arm distal end.

16. The sewing machine according to claim 1, wherein said means for reciprocally moving said take-up lever is operatively associated with said means for reciprocally moving said needle bar up and down.

17. The sewing machine according to claim 16, wherein:

said means for reciprocally moving said needle bar up and down including a drive shaft, an eccentric mounted to said drive shaft for rotation therewith, and a first connecting rod, said first connecting rod being pivotally eccentrically connected at a first end thereof to said eccentric, said first connecting rod being pivotally connected at a second end thereof to said needle bar;

said take-up lever being mounted for pivotal movement about a pivot point disposed between said proximal end and said distal end of said take-up lever; and, said means for reciprocally moving said take-up lever up and down including a second connecting link pivotally eccentrically connected at a first end thereof to said eccentric coaxial with said pivotal connection of said first connecting rod to said eccentric, said second connecting link being pivotally connected at a second end thereof to said take-up lever at said proximal end thereof.

18. The sewing machine according to claim 17, wherein:

said means for reciprocally moving said needle bar up and down including a drive shaft, a driving gear mounted to said drive shaft for rotation therewith, and a first connecting rod, said first connecting rod being pivotally eccentrically connected at a first end thereof to said driving shaft, said first connecting rod being pivotally connected at a second end thereof to said needle bar;

said take-up lever being mounted for pivotal movement about said proximal end thereof; and, said means for reciprocally moving said take-up lever up and down including a driven gear in mesh with said driving gear and a connecting link, said connecting link having a first end thereof being pivotally eccentrically connected to said driven gear, said connecting link having a second end thereof being pivotally connected to said take-up lever between said proximal end and said distal end thereof.

* * * * *

UNITED STATES PATENT AND TRADEMARK OFFICE

CERTIFICATE OF CORRECTION

PATENT NO : 6,047,653

DATED : April 11, 2000

INVENTOR(S) : David R. Cash

It is certified that error appears in the above-identified patent and that said Letters Patent are hereby corrected as shown below:

Col. 20, Line 7 (Claim 14) Delete "," after 'assembly'

Signed and Sealed this

Third Day of April, 2001

*Attest:*

Nicholas P. Godici

NICHOLAS P. GODICI

*Attesting Officer*

*Acting Director of the United States Patent and Trademark Office*